US007387352B2

(12) United States Patent
Florence et al.

(10) Patent No.: US 7,387,352 B2
(45) Date of Patent: Jun. 17, 2008

(54) PRINT OPTIMIZATION SYSTEM AND METHOD FOR DROP ON DEMAND INK JET PRINTERS

(75) Inventors: Richard N. Florence, Tolland, CT (US); Donald R. Allred, Springboro, OH (US)

(73) Assignee: Eastman Kodak Company, Rochester, NY (US)

( * ) Notice: Subject to any disclaimer, the term of this patent is extended or adjusted under 35 U.S.C. 154(b) by 343 days.

(21) Appl. No.: 10/967,990

(22) Filed: Oct. 19, 2004

(65) Prior Publication Data

US 2006/0082604 A1 Apr. 20, 2006

(51) Int. Cl.
*B41J 29/38* (2006.01)
*B41J 2/05* (2006.01)
*B41J 2/01* (2006.01)

(52) U.S. Cl. ..... 347/9; 347/57; 347/101

(58) Field of Classification Search ..... 347/9, 347/10, 54, 55, 56, 57, 68, 74, 75, 101, 102
See application file for complete search history.

(56) References Cited

U.S. PATENT DOCUMENTS 4,864,327 A * 9/1989 Shimosato ..... 347/10
5,413,839 A * 5/1995 Chatwin et al. ..... 428/32.6
5,557,304 A * 9/1996 Stortz ..... 347/15
5,600,356 A * 2/1997 Sekiya et al. ..... 347/62
5,838,349 A * 11/1998 Choi et al. ..... 347/55
5,997,123 A * 12/1999 Takekoshi et al. ..... 347/14
6,347,854 B1 * 2/2002 Okuda et al. ..... 347/15
6,364,462 B1 * 4/2002 Furukawa et al. ..... 347/55
6,869,157 B2 * 3/2005 Miyakoshi et al. ..... 347/9
7,264,344 B2 * 9/2007 Horie et al. ..... 347/100
2004/0104989 A1 * 6/2004 Hoshino ..... 347/102

* cited by examiner

*Primary Examiner*—Stephen D Meier
*Assistant Examiner*—Leonard S Liang
(74) *Attorney, Agent, or Firm*—The Buskop Law Group, P.C.

(57) ABSTRACT

A system and method for optimizing print quality of print media is for use on an ink jet printing system with a drop generator and an orifice plate disposed on the drop generator, wherein the orifice plate comprises nozzles forming a jet array. The drop generator is adapted to modulate ink volume per pixel by adjusting drop generator input voltage or drop generator pulse width. A corona discharge system is also used to form ionized air that contacts with a print media enhancing the wettability of the print media prior to exposing the print media to the drop generator. A controller operates the corona discharge system in tandem with the drop generator to optimize print quality by controlling drop spread and ink film thickness from the printhead onto the print media.

17 Claims, 1 Drawing Sheet

PRINT OPTIMIZATION SYSTEM AND METHOD FOR DROP ON DEMAND INK JET PRINTERS

FIELD OF THE INVENTION

The present embodiments relate to a print optimization system for ultraviolet (UV) imprinting on a variety of substrates using drop on demand ink jet printheads.

BACKGROUND OF THE INVENTION

Typical "Drop on Demand" ink jet devices rely on ink having sufficient low surface energy to properly wet a substrate and spread evenly over the surface of the substrate. Ultraviolet (UV) inks are typically in the 34-36 dynes/cm range, due in part to the chemistry being used and the need for reasonably high surface tension of the ink to provide good jetting properties in the Drop on Demand ink jet system.

Many of the materials that are desirable to be printed on, other than plain paper, have very low surface energy materials, such as an ultraviolet (UV) varnish disposed on them, or they are made from a high density polyethylene or a polypropylene. These polymer based materials or varnished materials typically have surface energies of less than 30 dynes/cm. Accordingly, the use of a typical ink on a difficult to print surface yields a non-wettable situation resulting in print quality deficiencies, such as white lines, holes in print, or very high ink thickness.

Solutions have been found in the traditional offset printing industry to pre-treat a surface, such as using a corona discharge or an ion plasma system. The use of these processes in ink jet printing can cause some benefits, but can also create negative effects if over-used, by reacting static forces or ionic charges that are significant problems to the charge plate of the printhead. Use of a strong pretreatment on high surface energy materials can create excessive wetting causing significant bad print quality issues, such as feathering or "exploded" drops.

A need exists for a process in the digital ink jet technology field that is able to change simply and easily the imprinting parameters to accommodate the needs of the specific substrate material that is being printed. A need exists for a method that yields consistently good print quality on a wide variety of materials. Due to a variety of ink jet and ink issues, the goal has never been successfully accomplished in the current art.

The present embodiments described herein were designed to meet these needs.

SUMMARY OF THE INVENTION

A system and method for optimizing print quality of print media is for use on an ink jet printing system with a drop generator and an orifice plate disposed on the drop generator, wherein the orifice plate comprises nozzles forming a jet array. The drop generator is adapted to modulate ink volume per pixel by adjusting drop generator input voltage or drop generator pulse width. A corona discharge system is also used to form ionized air that contacts with a print media enhancing the wettability of the print media prior to exposing the print media to the drop generator. A controller operates the corona discharge system in tandem with the drop generator to optimize print quality by controlling drop spread and ink film thickness from the printhead onto the print media.

BRIEF DESCRIPTION OF THE DRAWINGS

In the detailed description of the preferred embodiments presented below, reference is made to the accompanying drawings, in which.

Figure 1:
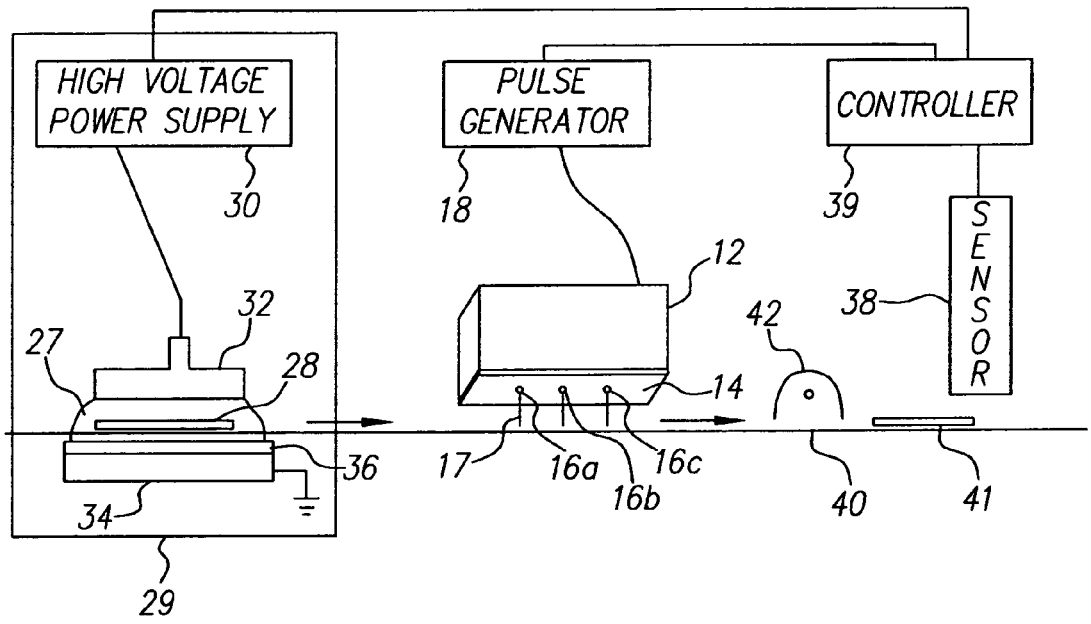
FIG. 1 depicts a schematic of an embodiment of a system for optimizing print quality of print media for an ink jet printing system.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The embodied systems and methods were designed to increase the wettability of the surface of print media and to control the drop size of ink from an ink jet printing system to improve print quality, particularly for "Drop on Demand" ink jet printers. These systems can be used with other types of printheads as well.

These methods and systems enable a user to obtain a higher level of print quality and resolution on a wide variety of print medias, such as, but not limited to plastics, paper, coated paper, and thin films, without changing the ink of the ink jet printers and without the need for specialized ink receptive media.

The embodied systems and methods increase the versatility of ink jet printing systems for use of a variety of inks.

These systems and methods provide an environmental benefit by providing a stream of controlled targeted ionized air to print media without a spattering effect that has an environmental benefit and a safety benefit for operators of the printing system.

The embodied systems and methods provide a significant benefit over existing chemical etching techniques that typically expose hazardous chemicals to the environment and to workers to create substrates that readily accept inks with fewer hazards from volatile chemicals and spills. The embodied systems and methods provide a significant improvement over mechanical abrasion techniques as well that typically can cause significant and objectionable changes to the surface of the media to be printed with the ink jet printer.

Using a drop generator with controlled pulses to affect drop size and a corona discharge system to ionize the surface of print media improves wettability and image quality by controlling drop spread and the resulting thickness of the ink.

With reference to the figures, FIG. 1 is an example of the system for optimizing the print quality of print media for an ink jet printing system is shown.

A typical ink jet system includes an ink jet printhead, such as a model DS 4350 available from Kodak Versamark™ of Dayton, Ohio, which has a drop generator 12.

An orifice plate 14 is disposed on the drop generator 12. The orifice plate 14 includes numerous nozzles 16*a*, 16*b*, and 16*c* that form a jet array 17 one liquid is flowed through the nozzles. For example, the model DS 4350 uses a two-dimensional jet array from 768 nozzles in a 300-dpi pattern.

The embodied print quality optimizing system includes a pulse generator 18. An example of a pulse generator 18 is one designed for and part of the DS 4350 printing system available from Kodak Versamark.

The pulse generator 18 is preferably adapted to form a pulse with an amplitude ranging from around 30 volts to around 200 volts, preferably between 90 volts and 105 volts. The pulse formed by the pulse generator 18 has a pulse width ranging from about 4 microseconds to about 15 microseconds, preferably between 6 microseconds and 8 microseconds. In a preferred embodiment for a DS 4350 printhead, the pulse is in the form of a trapezoidal wave with an amplitude of approximately 100 volts and a pulse width of 8 microseconds.

The pulses generated by the pulse generator 18 affect the drop generator 12 and change the amount of ink ejected from the nozzles 16*a*, 16*b* and 16*c*. Applying pulsing waves to the drop generator 12 changes the amount of ink ejected from the nozzles causing the ink jet drop size to modulate. The drops impact print media 28, which can be moving, on a print media transport as shown in FIG. 1. The print media can be moved by a media transport device 40 for transporting the print media 28 horizontally.

The pulse generator 18 is typically located on a printhead amplifier circuit (not shown). Typically, the pulse generator uses a 150-volt DC input to create a usable wave, such as a square wave, in the form of electrical pulses. Different types of wave forms can be used, not only square and trapezoidal as already mentioned, but sine pulses and other shaped waves.

The pulse generator 18 connects to a controller 39. The controller 39 connects to a corona discharge system 29, whose parts are depicted within the dotted box in FIG. 1. The corona discharge system includes a high voltage power supply 30. The controller 39 controls power from the high voltage power supply to a discharge electrode 32. The discharge electrode ionizes air, forming ionized air 27 that impacts the surface of print media 28. The corona discharge system also has insulation 36, so as to prevent against electrical shocks and a ground plate 34 to ground the corona discharge system.

As an example, an ultra-violet (UV) curable ink can be used with this system. For UV inks, an ultraviolet curing station 42 should also be used with the embodied systems to facilitate the curing of ultraviolet inks after the ink is deposited on the print media 28, following printing using the pulse generator.

In still another embodiment, hot melt inks, water-based inks, polymer based inks, and solvent-based inks can be used with the embodied systems without requiring additional equipment.

The amount of air to be ionized with the corona discharge system prior to printing on the print media can be adjusted. The adjustments vary the degree of surface energy modification caused by the ionized air for a particular print media, such as a thin film plastic bag. By contacting of the surface of the print media, such as the thin film plastic for bags, with ionized air, the wettability of the print media is enhanced. Ink is then applied to the ionized print media from the drop generator forming the 300 dpi high quality, high resolution image. The dpi can range from this number by at least 200 dpi providing even better image quality and resolution.

In an alternative embodiment, the corona discharge system can be modified to create plasma that can be targeted at specific regions of the print media to affect the adhesion of the ink to the media.

The embodied methods and systems can use air mixed with other gases, such as oxygen, to increase further, alter, or modify the wettability of the print media. Inert gasses, such as argon, can be added to lower the explosive situation potential while effectively maintaining ionization of the air or controlling the plasma being directed at the print media. The inert gases, when used, can advantageously reduce adverse effects on the media, such as overheating, which may occur.

The controller 39 of the drop generator and pulse generator is additionally used to operate the corona discharge system to ensure the corona discharge system works in conjunction, in tandem, and in some cases, in sequence with the pulse generator and the ink jet system.

The system can further include one or more sensors 38 connected to the controller 39 to enable the controller to modify the ionization target area, the amount or intensity of the pulses on a "real time" on-line basis without shutting off the printer. Sensors that are contemplated are optic sensors that can inspect the print media and communicate a signal that the controller compares to preset limits in order to adapt the pulse generator or corona discharge system. The sensors are adapted to read line widths then via the controller can engage automatically the pulse generator and corona discharge system. Vision system sensors are commonly commercially available are contemplated for use herein.

In the embodied methods, the pulse generator can form pulses that cause the amount of ink ejected from one or more nozzles to change, more specifically to be modulated. By modulating the nozzles, the drop size added to the media is directly affected. While a percentage change in the size of the pulse and the percentage change of the drop size is not an exact one to one relationship, typically a 10% change in the size of the pulse affects the drop size by about 10%. For example, if a pulse has an amplitude of 100 volts and is increased to 110 volts, the drop size is expected to increase by 10%.

In an alternative method, ink usage can be minimized by using a high intensity ionization power, such as six watts per square foot, while using only a small amount of ink, such as 30 picoliters per drop size. If a user requires less ionization, such as three watts per square foot, a drop size of 60 picoliter can be used to obtain a line size similar to the line size the previous example. The user determines the method and combinations of the ionization power and drop size needed based on the user's desire for raised print or the user's desire for a certain tactile feel of the printed media. Similarly, a user can determine which combination provides the desired durability of the print, based on the intended purpose of the printed material.

These systems and methods enable the surface energy of the media to be modified selectively by the user. The surface energy of the media can be changed to be highly user friendly based on the user's specifications or needs. For example, an operator can visually inspect media coming out of the ink jet printing system and, based on the thickness of lines and length of lines, the user can manually adjust the magnitude of the ionized air contacting the print media or manually adjust the pulse generator. The magnitude of the ionized air contacting the print media or the pulse generator can be automatically adjusted as described above.

One sensor or up to two sensors per jet array can be used. In the most preferred embodiment, one sensor per jet is preferably adapted to read line widths and automatically engage the pulse generator and corona discharge system when the line widths do not meet a preset value.

The print media usable with the embodied methods and systems can be any number of substrates or media. For example, the media can be paper, vinyl, thermo graphic media, polyethylene substrate, polypropylene substrate, styrene, epoxy, polyamide, acrylic, ultraviolet cured lacquer, ultraviolet cured coating, composites thereof, laminates thereof, or combinations thereof. Coated paper can be used as well.

Multi-step printing is particularly enhanced using the embodied methods and systems. For example, after magenta is printed on a substrate, these methods and systems can be used on the printed media to make the just printed ink wettable in order to allow another color, such as cyan, to be printed clearly with high resolution and clarity over the magenta.

In an alternative embodiment, a print quality optimizing method can be used for traveling media for an inkjet printhead. The traveling media means that the printhead is moving, the media is moving, or both the printhead and the media are moving. In this alternative embodiment, multiple droplets are created for a single addressable pixel on media using multiple pulse pulses. Each pulse has an amplitude ranging from about 30 volts to about 200 volts. Each pulse has a pulse width ranging from about 4 microseconds to about 15 microseconds. Using multiple drops enables the ink to contact the traveling print media at the same pixel address before media advances at least one half of an addressable pixel.

Various inks can be used in this process, such as aqueous inks, solvent based inks, polymer based inks.

The embodied methods can be used for 300×300 dpi printing using standard, heavy or light inks. These methods permit the use of standard heavy and light inking with standard heavy or light plasma treatment. Table 1 examples particular examples of how the variables of surface energy and type materials can be used.

TABLE 1

| For 300 × 300 dpi | Magnitude of Ionizing Power Density | | |
|---|---|---|---|
| Drop Size | No Treatment | 3 Watts/ft$^2$ | 6 Watts/ft$^2$ |
| 30 picoliter | 46-58 dynes/cm | 38-46 dynes/cm | 30-38 dynes/cm |
| 60 picoliter | 38-46 dynes/cm | 30-38 dynes/cm | 25-30 dynes/cm |
| 120 picoliter | 30-38 dynes/cm | 25-30 dynes/cm | 22-25 dynes/cm |

The embodiments have been described in detail with particular reference to certain preferred embodiments thereof, but it will be understood that variations and modifications can be effected within the scope of the embodiments, especially to those skilled in the art.

PARTS LIST

12 drop generator
14 orifice plate
16*a* nozzle
16*b* nozzle
16*c* nozzle
17 jet array
18 pulse generator
27 ionized air
28 print media
29 corona discharge system
30 high voltage power supply
32 discharge electrode
34 ground plate
36 insulation
38 sensor
39 controller
40 media transport device
41 printed media
42 curing station

The invention claimed is:

1. A ink jet printing system for optimizing print quality of print media for an ink jet printing system, wherein the ink jet printing system comprises:

a. an ink jet printhead drop generator and an orifice plate disposed on the drop generator, wherein the orifice plate has a plurality of nozzles forming a jet array;

b. a pulse generator connected to the drop generator and adapted to apply pulses to the drop generator which modulate ink volume per pixel from the drop generator to affect drop size by adjusting drop generator input voltage or drop generator pulse width;

c. a corona discharge system having a discharge electrode which forms ionized air that pre-treats the print media to improve wettability of the print media prior to printing with the drop generator, wherein the ionized air contacts with the print media enhancing the wettability of the print media prior to exposing the print media to the drop generator; and d. a controller connected to a power supply for the discharge electrode of the corona discharge system and connected to the pulse generator for the drop generator, and adapted to operate the corona discharge system in tandem with the drop generator, which adjusts ionization intensity of the corona discharge system by controlling power to the discharge electrode, and which modulates the ink volume from the drop generator by controlling the pulses applied from the pulse generator to the drop generator to adjust drop generator input voltage or drop generator pulse width, thereby optimizing print quality by controlling drop spread and ink film thickness on the print media due to adjusted ionization intensity and modulated ink volume.

2. The system of claim 1, wherein the controller is a microprocessor with display that permits an operator to modulate the ink volume from the drop generator and to adjust ionization intensity of the corona discharge system based on a visual or tactile determination as to drop spread and ink film thickness on the printed media.

3. The system of claim 1, wherein the pulse generator forms a pulse with an amplitude ranging from about 30 volts to about 200 volts and a pulse width ranging from about 4 microseconds to about 15 microseconds, and wherein said pulse modulates the amount of ink ejected from at least one nozzle of the orifice plate.

4. The system of claim 3, wherein the amplitude ranges from about 90 volts to about 105 volts.

5. The system of claim 3, wherein the pulse width ranges from about 6 microseconds to about 8 microseconds.

6. The system of claim 1, further comprising at least one sensor connected to the controller, wherein the sensor is adapted to read line widths and adapted to actuate the controller to modulate the ink volume from the drop generator via the pulse generator connected to the drop generator when the line widths do not meet a preset value.

7. The system of claim 1, further comprising at least one sensor connected to the controller, wherein the sensor is adapted to read line widths and adapted to actuate the controller to adjust ionization intensity of the corona discharge system via the power supply for the discharge electrode when the line widths do not meet a preset value.

8. The system of claim 1, wherein the print media is selected from the group consisting of paper, vinyl, thermo graphic media, polyethylene substrates, polypropylene substrates, styrene, epoxy, polyamides, acrylics, ultraviolet cured lacquers, ultraviolet cured coatings, composites thereof, laminates thereof, and combinations thereof.

9. A method for optimizing print quality of print media for an ink jet printing system, wherein the ink jet printing system comprises an ink jet printhead drop generator and an orifice plate that is disposed on the drop generator and includes a plurality of nozzles forming a jet array, and wherein the method comprises the steps of:

a. applying pulses to the drop generator from a pulse generator to modulate ink volume per pixel to affect drop size by adjusting drop generator input voltage or drop generator pulse width;

b. forming ionized air via a discharge electrode of a corona discharge system to pre-treat the print media to improve wettability of the print media prior to printing with the drop generator, wherein the ionized air contacts with the print media enhancing the wettability of the print media prior to exposing the print media to the drop generator; and c. operating the corona discharge system in tandem with the drop generator via a controller connected to a power supply for the discharge electrode of the corona discharge system and connected to the pulse generator for the drop generator, including adjusting ionization intensity of the corona discharge system by controlling power to the discharge electrode, and including modulating the ink volume from the drop generator by controlling pulses applied from the pulse generator to the drop generator to adjust drop generator input voltage or drop generator pulse width, thereby optimizing print quality by controlling drop spread and ink film thickness on the print media due to adjusted ionization intensity and modulated ink volume.

10. The method of claim 9, wherein step b. in claim 9 is a selective process based on user specifications or user needs.

11. The method of claim 9, wherein the step of pulsing of the drop generator is a selective process based on user specifications or user needs.

12. The method of claim 9, wherein the step of pulsing of the drop generator is automatically performed based on post printing sensing of line widths in the print media and comparing the line widths to a preset value.

13. The method of claim 9, wherein step b. in claim 10 is automatically performed based on post printing sensing of line widths in the printed media.

14. The method of claim 9, wherein the print media is selected from the group consisting of paper, vinyl, thermo graphic media, polyethylene substrate, polypropylene substrates, styrene, epoxy, polyamide, acrylic, ultraviolet cured lacquers, ultraviolet cured coatings, composites thereof, laminates thereof, and combinations thereof.

15. The method of claim 9, wherein the drop generator pulse width ranges from about 6 microseconds to about 8 microseconds.

16. The method of claim 9, wherein the drop generator input voltage has an amplitude ranging from about 90 volts to about 105 volts.

17. The method of claim 9, further comprising the step of generating at least one pulse per nozzle of the orifice plate.

* * * * *